United States Patent [19]

Moskowitz

[11] 4,176,329

[45] Nov. 27, 1979

[54] TONE CONTROL CIRCUIT

[75] Inventor: Jacob F. Moskowitz, Brookline, Mass.

[73] Assignee: Massachusetts Institute of Technology, Cambridge, Mass.

[21] Appl. No.: 814,696

[22] Filed: Jul. 11, 1977

Related U.S. Application Data

[63] Continuation of Ser. No. 649,400, Jan. 15, 1976, abandoned.

[51] Int. Cl.[2] ..... G10H 1/00

[52] U.S. Cl. ..... 333/28 T; 84/1.11; 84/1.22; 179/1 D; 328/127; 328/167; 333/167

[58] Field of Search ..... 84/1.01, 1.11, 1.19, 84/1.22, 1.24, DIG. 9; 179/1 D; 328/127, 167; 330/107, 109, 126; 333/28 T, 70 R

[56] References Cited

U.S. PATENT DOCUMENTS 3,911,776 10/1975 Beigel ..... 84/1.11

*Primary Examiner*—Stanley J. Witkowski

*Attorney, Agent, or Firm*—Arthur A. Smith, Jr.; Martin M. Santa

[57] ABSTRACT

A tone control circuit using only one potentiometer to provide bass or treble control is described. An integrator and a differentiator are connected to the input of the circuit and their outputs to the two ends of the potentiometer. Electrical connection between the potentiometer and the input is also made to provide a flat frequency characteristic component in the output signal.

6 Claims, 3 Drawing Figures

TONE CONTROL CIRCUIT

The Government has rights in this invention pursuant to CG-0002 awarded by the National Science Foundation.

This is a continuation, of application Ser. No. 649,400 filed Jan. 15, 1976, and now abandoned.

BACKGROUND OF THE INVENTION

This invention relates generally to electronic tone controls, especially those for musical instruments, and in particular describes a novel tone control providing a great range of control with a single knob.

Many tone controls have two knobs, one for controlling the level of bass or low frequencies, the other for treble or high frequencies. Other types have three knobs: two for the functions described above and a third for the middle range of frequencies.

More economical, simple controls provide only a single control knob which typically serves only as an attenuator for high frequencies. In certain multichannel audio devices, for example, multichanneled stringed musical instruments as described in U.S. patent application $\pi$611048, filed Sept. 8, 1975, now U.S. Pat. No. 4,069,732 and assigned to the assignee of this application, it becomes desirable to exercise a great deal of tonal control over each channel as with multiknob tone controls. yet not to multiply the number of knobs necessary to the point of confusion. Accordingly, a primary object of the present invention is to provide a circuit which provides bass and treble boost, yet still provides the option for passing the input signal unaffected and to select between these options continuously with a single knob.

A further object of this invention is to provide radically different waveshapes for a square wave input, a fairly common waveform resulting from overdriving or clipping a sinusoidal waveform of the kind produced by stringed musical instruments. Briefly, these objects have been achieved by devising a circuit consisting of a differentiator, an integrator, and a potentiometer connected to their outputs and to the circuit input to control the frequency characteristic of the output signal.

A better understanding of the invention is provided by referring to the preferred embodiments discussed below and illustrated in the accompanying drawings.

THE INVENTION

Figure 1:
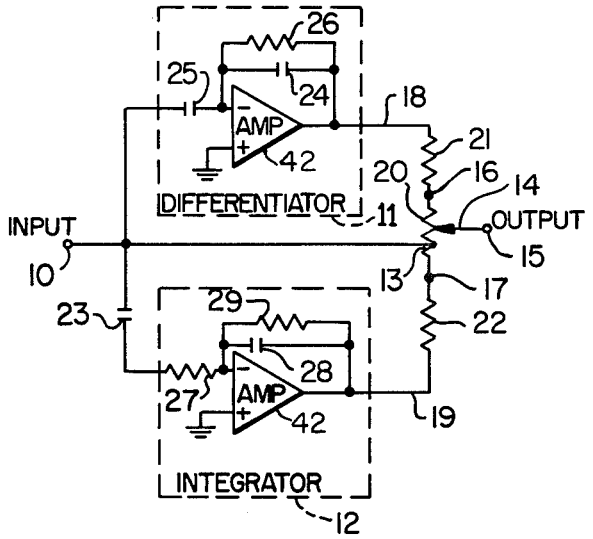
FIG. 1 is a partial schematic block diagram of tone control circuit of this invention.

Referring first to FIG. 1, terminal 10 indicates the input of the circuit. This input is connected to the differentiator 11, integrator 12 and the centertap 13 of potentiometer 20. The wiper 14 of said potentiometer is connected to output terminal 15. The terminals 16 and 17 of potentiometer 20 are connected through resistors 21, 22 to the output terminals 18, 19 of the differentiator 11 and integrator 12, respectively. Potentiometer 20 preferably has a resistance significantly greater than the output impedances of either the integrator 12 or the differentiator 11 in order to minimize the effect of the change in loading on them produced when the potentiometer wiper 14 is moved.

By moving the wiper 14 of potentiometer 20, it is possible to continuously provide mixtures of the original signal and the differentiated (i.e., a monotonically high-passed) input signal or of the original signal and the integrated (or monotonically low-passed) original signal. If it is assumed that resistors 21, 22 are negligibly small compared to the resistance of potentiometer 20, it can be readily seen that either essentially only the input signal alone, the integrated signal alone, or the differentiated signal alone may be chosen as output when the wiper 14 is at the center, bottom or top, respectively, of potentiometer 20 as viewed in FIG. 1. Intermediate portions of wiper 14 produce a corresponding blend or mixture of signals.

Resistors 21 and 22 are provided to limit the excursion of the control should more subtle changes of the original signal be desired. These resistors are selected to be very low resistance when nearly the full range of the tone control 20 is desired. Capacitor 23 is used to prevent integrator 12 from saturating due to dc offset currents.

Figure 2:
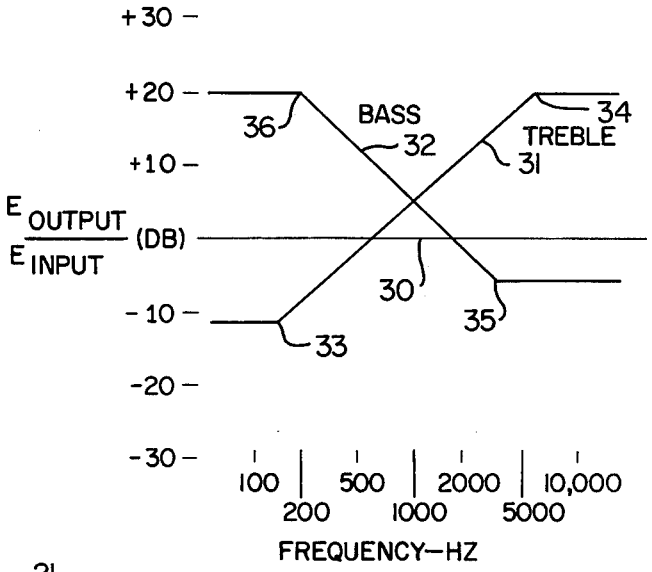
FIG. 2 illustrates approximate frequency response curves for various settings of the tone control.

Referring to FIG. 2, curve 30 indicates the frequency response of this circuit when the wiper 14 of potentiometer 20 is at the center position. The response is flat indicating that the input signal is unchanged. Moving wiper 14 towards potentiometer end 16 results in curve 31 which shows a monotonic increase with frequency over most of the audio range. The total energy output is maintained essentially constant so that the tone changes are not accompanied by undesired loudness changes. This is accomplished by selecting resistor 26 of FIG. 1 and capacitor 25, to maintain roughly equal loudness over the frequency range of interest. The portion of curve 31 left of point 33 shows the contribution from the original signal. The portion of curve 31 between the points 33 and 34 indicates the differentiator's contribution. The point 33 is determined by the setting of tone control potentiometer wiper 14.

The portion of curve 31 right of point 34 represents the maximum gain allowed the differentiator and is determined by the choice of capacitor 24 of FIG. 1. Still referring to FIG. 2, curve 32 represents the frequency response with the potentiometer wiper between the center and potentiometer end 17. This curve shows a monotonic decrease with frequency over most of the audio range. As before, the loudness is kept relatively constant by choosing resistor 27 and capacitor 28 appropriately. The levelling off point 35 is determined by the position of wiper 14. The maximum gain, reached at point 36, is determined by the choice of resistor 29.

Thus the frequency response of the system may be drastically altered merely by the adjustment of one knob, that engaging wiper 14. It will be seen by those skilled in the art that the wave shaping properties mentioned are provided by the use of integrators and differentiators in this way.

Figure 3:
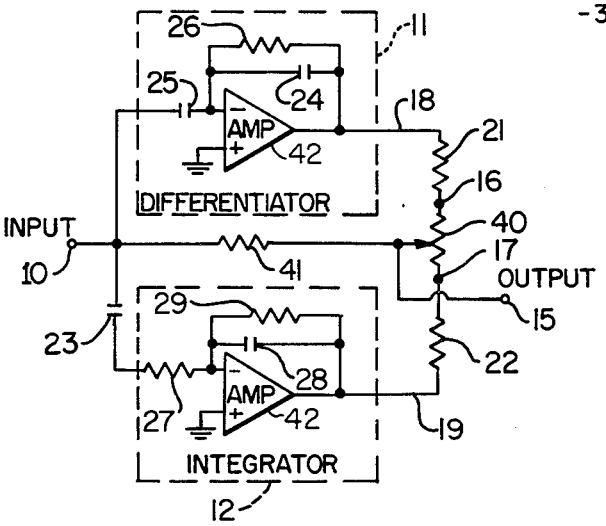
FIG. 3 is a partial schematic block diagram of an alternate embodiment of the tone control circuit of this invention.

Referring to FIG. 3, the same general principles and operation already discussed hold true for this embodiment also. FIG. 3 differs from FIG. 1 in that potentiometer 40 is not center-tapped but a more conventional 3-terminal potentiometer. Another difference is that a resistor 41 is connected between the input and output terminals instead of the direct connections from the input to center-tap 13 of the potentiometer 20. Potentiometer 40 is chosen to be much greater than resistor 41, which in turn is chosen to be much greater than the sum of the output impedance of differentiator 11 and resistor 21 and also much greater than the sum of the output impedance of integrator 12 and resistor 22. The resistor 41 provides a signal from the input terminal 10 directly to the output terminal 15. The position of the arm 14 of potentiometer 40 determines the amount of treble or bass frequencies in the output relative to the "flat-frequency" component contributed by resistor 41.

The differentiator 11 and integrator 12 are circuits well known to those skilled in the art and each contains an operational amplifier 42. An operational amplifier is an amplifier having high gain high input impedance and low output impedance. A typical operational amplifier is a type 741 integrated circuit amplifier made by the Fairchild Co. and other manufacturers which was used in the embodiments of this application.

While specific examples of the invention have been described, it will be apparent that many modifications and variations may be effected without departing from the scope of the novel concepts of this invention.

What is claimed is:

1. An electronic tone control circuit comprising, an integrator circuit having an input terminal and an output terminal, a differentiator circuit having an input terminal and an output terminal, first means for electrically connecting the input terminals of said integrator circuit and differentiator circuit to each other to provide the tone control circuit input terminal, a potentiometer having end terminals, a wiper arm terminal, and a center-tap terminal, second means for electrically connecting the output terminals of said integrator circuit and said differentiator circuit to said potentiometer end terminals, respectively; the wiper arm terminal providing the output terminal of said tone control circuit, third means for electrically connecting said center-tap terminal of the potentiometer to the control circuit input terminal.

2. The tone control circuit of claim 1 wherein said second means for electrically connecting comprises, a first resistor connected between the output terminal of said differentiator circuit and one end of said potentiometer, a second resistor connected between the output terminal of said integrator circuit and the other end of said potentiometer.

3. The circuit of claim 2 wherein, said third means for electrically connecting comprises a direct electrical connection between said tone control circuit input and said center-tap connection.

4. An electronic tone control circuit comprising, an integrator circuit having an input terminal and an output terminal, a differentiator circuit having an input terminal and an output terminal, first means for electrically connecting the input terminals of said integrator circuit and differentiator circuit to each other to provide the tone control circuit input, a potentiometer having end terminals and a wiper arm terminal, second means for electrically connecting the output terminals of said integrator circuit and said differentiator circuit to said potentiometer end terminals, respectively; the wiper arm terminal providing the output terminal of said control circuit, impedance means electrically connecting said tone control circuit output terminal to the tone control circuit input terminal.

5. The tone control circuit of claim 4 wherein said second means for electrically connecting comprises, a first resistor connected between the output terminal of said differentiator circuit and one end of said potentiometer, a second resistor connected between the output terminal of said integrator circuit and the other end of said potentiometer.

6. The circuit of claim 5 wherein said impedance means for electrically connecting comprises a resistor connected between said tone control circuit input and said tone control circuit output terminal.

* * * * *